US006593887B2

(12) United States Patent
Luk et al.

(10) Patent No.: US 6,593,887 B2
(45) Date of Patent: Jul. 15, 2003

(54) WIDEBAND PATCH ANTENNA WITH L-SHAPED PROBE

(75) Inventors: Kwai Man Luk, Hong Kong (HK); Yung Chow, Hong Kong (HK); Chi Lun Mak, Hong Kong (HK)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 09/766,763

(22) Filed: Jan. 22, 2001

(65) Prior Publication Data

US 2001/0043157 A1 Nov. 22, 2001

Related U.S. Application Data

(63) Continuation-in-part of application No. 09/236,883, filed on Jan. 25, 1999, now abandoned.

(51) Int. Cl.[7] ..... H01Q 1/38
(52) U.S. Cl. ..... 343/700 MS; 343/846
(58) Field of Search ..... 343/700 MS, 846, 343/848, 702, 853; H01Q 1/38

(56) References Cited

U.S. PATENT DOCUMENTS

| | | | | |
|---|---|---|---|---|
| 4,686,535 A | | 8/1987 | Lalezari | 343/700 MS |
| 4,724,443 A | * | 2/1988 | Nysen | 343/700 MS |
| 5,281,974 A | | 1/1994 | Kuramoto et al. | 343/700 MS |
| 5,572,222 A | * | 11/1996 | Mailandt et al. | 343/700 MS |
| 5,995,047 A | | 11/1999 | Freyssinier et al. | 343/700 MS |
| 6,002,369 A | | 12/1999 | Richard | 343/700 MS |
| 6,028,561 A | | 2/2000 | Takei | 343/700 MS |
| 6,317,084 B1 | * | 11/2001 | Chen et al. | 343/700 MS |

OTHER PUBLICATIONS

Lee et al. "Experimental and simulation studies of the coaxially fed U–slot rectangular patch antenna" *IEE Proc-Microw. Antennas Propag.* vol. 144, No. 5, 1997, pp. 354–358.

Lee et al. "Characteristics of a two–layer electromagnetically coupled rectangular patch antenna" *Electronic Letters* vol. 23, No. 20, Sep. 24, 1987, pp. 1070–1072.

Hall "Probe Compensation in Thick Microstrip Patches" *Electronic Letters* vol. 23, No. 11, May 21, 1987 pp. 606–607.

* cited by examiner

*Primary Examiner*—Hoanganh Le
(74) *Attorney, Agent, or Firm*—Merchant & Gould, P.C.

(57) ABSTRACT

An antenna design comprises a patch that may be rectangular, circular, triangular or any other geometric shape and which is disposed by a dielectric a distance above a ground plane. The patch is driven by an L-shaped probe disposed between the patch and the ground plane. The probe has a first portion normal to both the patch and the ground plane, and a second portion parallel to the patch and the ground plane. The lengths of the two portions are selected so that the inductive reactance of the first portion is cancelled by the capacitive reactance of the second portion. In alternative embodiments a plurality of such patch antennas may be connected together via a single transmission network to form an antenna array.

15 Claims, 9 Drawing Sheets

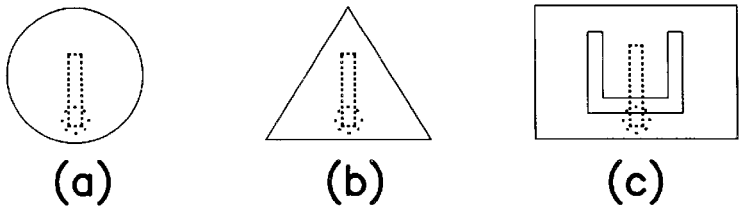
FIG. 3
FIG. 4
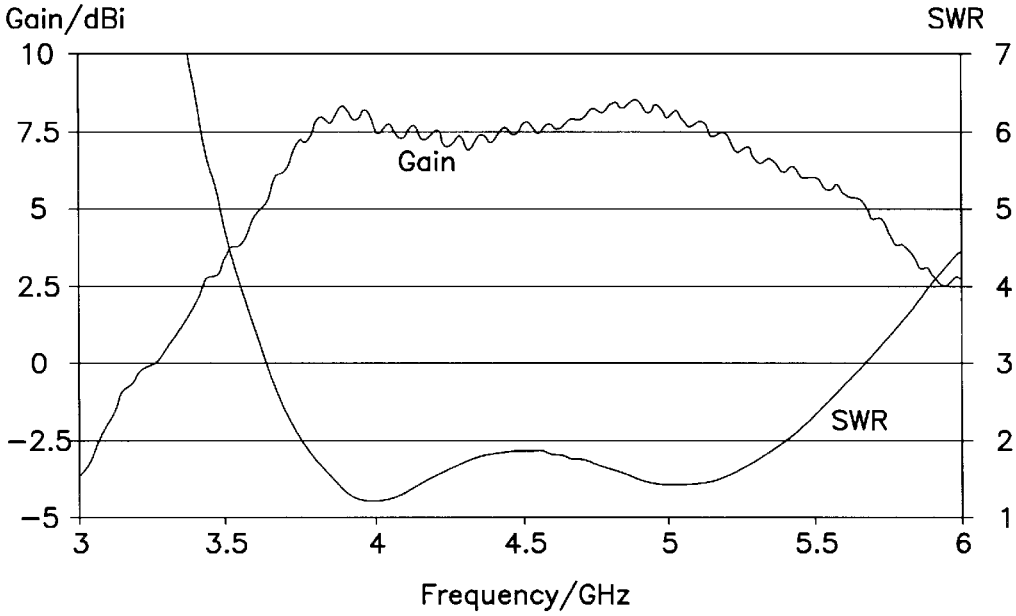

WIDEBAND PATCH ANTENNA WITH L-SHAPED PROBE

This application is a Continuation-In-Part of U.S. application Ser. No. 09/236,883, filed Jan. 25, 1999 now abandoned.

FIELD OF THE INVENTION

This invention relates to a patch antenna, and in particular to a wideband patch antenna fed by an L-shaped probe. The invention further relates to antenna arrays comprising a plurality of patch antennas.

BACKGROUND OF THE INVENTION

Microstrip patch antennas have become very popular in recent years for a wide variety of applications. They have a number of advantages including low cost, small size and light weight that make them very suitable, for example, for use in Personal Communication Systems.

A conventional microstrip patch antenna comprises a patch of a given geometrical shape (eg circular, rectangular, triangular) spaced from a ground plane and separated from the ground plane by a dielectric. Normally the patch is fed by means of a coaxial feed.

PRIOR ART

One drawback, however, with microstrip patch antennas is that they have a relatively low bandwidth and are not therefore generally suitable for broad bandwidth applications. A number of approaches have been taken over the years to try and increase the bandwidth of microstrip patch antennas. Prior proposals, for example, have included adding second parasitic patch electromagnetically coupled to the driven patch (R. O. Lee, K. F. Lee, J. Bobinchak *Electronics Letters* Sep. 24, 1987 Vol.23 No.20 pp1017–1072), tuning out the probe inductance with a capacitive gap which allows the use of a thick substrate (P. S. Hall *Electronic Letters* May 21, 1987 Vol.23 No.11 pp606–607), and including a U-shaped slot in the patch antenna (K. F. Lee et al *IEE Proc. Microw. Antennas Propag.*, Vol.144 No.5 October 1997).

None of these prior approaches to the problem are ideal however. The use of a parasitic patch overlying the driven patch undesirably increases the thickness of the antenna. The capacitive gap needs to be fabricated with high precision. Introducing a U-shaped slot gives an antenna with high cross-polarization and cannot be used for circularly polarized radiation. These remains a need for a simple patch antenna design that has increased bandwidth without introducing further drawbacks.

Another example of the prior art is shown in U.S. Pat. No. 4,724,443 (Nysen). Nysen describes a patch antenna in which a stripline feed element is coupled electromagnetically to a patch, and in which one end of the strip (which is parallel to the patch) is connected by the inner conductor of a coaxial cable (which is normal to the patch). In this design only the strip is coupled to the patch, and the antenna is not wide in its bandwidth.

SUMMARY Of THE INVENTION

According to the present invention there is provided an antenna comprising a patch disposed above a ground plane and spaced therefrom by a dielectric material, and an L-shaped probe disposed between said patch and said ground plane, said L-shaped probe having a first portion normal to said ground plane and said patch, and a second portion parallel to said ground plane and said patch, said antenna further comprising means for connecting said probe to means for transmitting a signal to or from said antenna, and said first portion of said L-shaped probe extending through said ground plane, wherein both said first portion and said second portion of said L-shaped probe are adapted to be electromagnetically coupled to said patch.

In a particularly preferred embodiment of the present invention the first portion of the L-shaped probe has an inductive reactance determined by the length of the first portion, and the second portion has a capacitive reactance determined by the length of the second portion, the respective lengths of the first and second portions being selected such that the inductive reactance of the first portion is cancelled by the capacitive reactance of the second portion.

The patch may be rectangular, circular or triangular or indeed any other geometric shape. The patch may also be provided with a slot which may be of various shapes, for example a U-shaped slot.

In one particularly preferred example of the invention there is provided an antenna comprising a rectangular patch of dimensions $W_x$ by $W_y$ disposed above a ground plane and spaced therefrom by a dielectric material (eg a foam material) by a distance H, and an L-shaped probe disposed between said patch and said ground plane, said L-shaped probe having a first portion of length $L_h$ normal to said ground plane and said patch, and a second portion of length $L_v$ parallel to said ground plane and said patch and spaced from one edge of the patch by a distance S, said antenna further comprising means for connecting said probe to means for transmitting a signal to or from said antenna, wherein said antenna has the dimensions:

$W_x=0.45\lambda$
$W_y=0.375\lambda$
$H=0.099\lambda$
$L_v=0.16\lambda$
$L_h=0.083\lambda$
$S=0.03\lambda$ The antenna may be a single antenna with one patch and one L-shaped probe. However, viewed from another aspect the invention provides an antenna array comprising a plurality of patches disposed above a ground plane and spaced therefrom by a dielectric material, each said patch having a respective L-shaped probe disposed between said patch and said ground plane, each said L-shaped probe having a first portion normal to said ground plane and said patch, and a second portion parallel to said ground plane and said patch said antenna array further comprising a transmission network connecting said probes to each other and to means for transmitting a signal to or from said antenna array.

Such an antenna array may take a number of forms. In its simplest form the array may comprise two patches with their respective L-shaped probes being connected by a single transmission line. More elaborate arrays may also be formed, for example a 4×1 array with four L-shaped probes connected to a single transmission line. Or a 2×2 array formed of two pairs of patches with the L-shaped probes of each patch being connected by a transmission line, and the two transmission lines being connected by a third so as to form a single transmission network to which all probes are attached. Two such 2×2 arrays may then be connected together to form a 4×2 array.

Another possibility is that in an antenna array the individual L-shaped probes may be connected by a microstrip feedline disposed below the ground plane.

A preferred particular example of an antenna array comprises two rectangular patches having dimensions W×L disposed above a ground plane and spaced a distance $H_1$ therefrom by a dielectric material (eg air), each said patch having a respective L-shaped probe disposed between said patch and said ground plane, each said L-shaped probe having a first portion normal to said ground plane and said patch, and a second portion parallel to said ground plane spaced by a distance $H_2$ therefrom and having a length D, said antenna array further comprising a transmission line connecting said probes to each other and to means for transmitting a signal to or from said antenna array, said transmission line being parallel to said ground plane and spaced therefrom by a distance $H_3$, said transmission line having a thickness S, a width S, and a length λ/2, and wherein $W=0.42\lambda$ $L=0.377\lambda$ $H_1=0.127\lambda$ $H_2 0.09\lambda$ $H_3=0.033\lambda$ $S=0.039\lambda$ $D=0.171\lambda$ It will also be understood that the patch antennas may be spaced from the ground plane by any form of dielectric material (including air) or indeed by multiple layers of differing dielectric materials.

BRIEF DESCRIPTION OF THE DRAWINGS

Some embodiments of the invention will now be described by way of example and with reference to the accompanying drawings, in which:

FIG. 4 is a plot showing gain and SWR against frequency for the antenna of FIGS. 1 and 2.

DETAILED DESCRIPTION OF PREFERRED EMBODIMENTS

Figure 1:
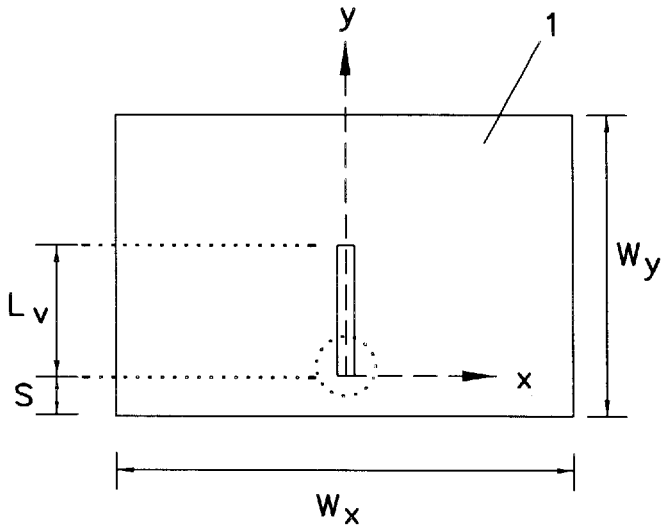
FIG. 1 is a plan view of an antenna according to a first embodiment of the invention.
Figure 2:
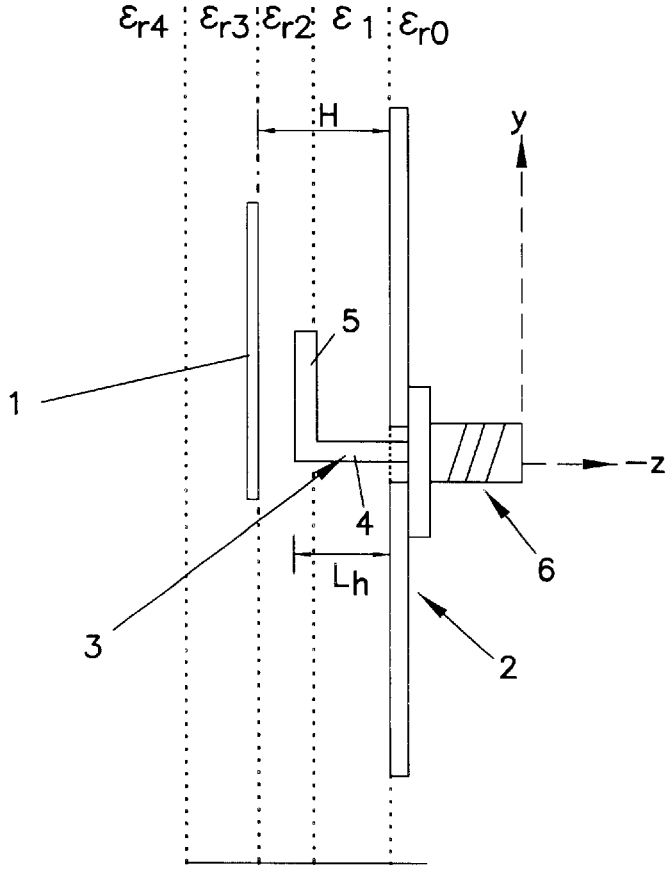
FIG. 2 is a side view of the antenna of FIG. 1, FIGS 3(*a*)–(*c*) are plan views showing alternative patch shapes.

Referring firstly to FIGS. 1 and 2 there is shown a microstrip patch antenna according to a fifth embodiment of the present invention. The antenna comprises a rectangular patch 1 spaced a distance H from a ground plane 2. An L-shaped probe 3 has a first part 4 extending through the ground plane and at right angles to both the ground plane 2 and the rectangular patch 1, and a second part 5 that is parallel to the ground plane 2 and the rectangular patch 1. The first part 4 of the L-shaped probe 3 has a length $L_h$ extending to the side of the second part 5 of the L-shaped probe nearest the patch 1. The second part 5 of the L-shaped probe 3 has a length $L_v$. Both parts of the L-shaped probe have a circular cross-section. The L-shaped probe 3 is connected to a coaxial feed by means of connector 6. The cross-section of the L-shaped probe can be a rectangular shape.

Both parts of the L-shaped probe are adapted to couple electromagnetically with the patch. An advantage of this is that it facilitates the design of a wideband antenna. For a wideband antenna the separation between the patch and the ground plane needs to be relatively large with a thick substrate between the patch and the ground plane. The substrate needs to be from about 8% to 12% of the operating wavelength. This thick substrate means that the first portion of the L-shaped probe (the portion extending normal to the ground plane) needs to be relatively long to excite the patch. However the length of the first portion defines its inductive reactance ($X_L$) and this therefore increases as the length of the first portion increases. This inductive reactance is detrimental to the performance of the antenna, but in the design of an antenna according to a preferred embodiment of the invention, the inductive reactance of the first portion can be at least substantially cancelled out by selecting the length of the second portion of the probe (which extends parallel to the patch) such that a capacitive reactance $X_c$ is created where $X_L+X_c\approx 0$. Typically for example of the length of the second portion may be in the range of 0.09λ to 0.15λ.

In particular $$X_L = j120\tan(0.5kL_h)\ln\left(\frac{1.125}{kr}\right) \quad \text{(based on curve fitting formula)}$$

$$X_c = -j\frac{Z_o\cosh^{-1}\left(\frac{H-L_n}{r}\right)}{2\pi\tan(kL_v)} \quad \text{(based on transmission line theory)}$$

where $k$ is the wavenumber, $r$ is radius of the probe, and $Z_0$ is the intrinsic wave impedance.

The rectangular patch 1 has a width $W_x$ in a direction along an x axis at right angles to the second part 5 of the L-shaped probe 3, and a length $W_y$ in a direction along a y axis parallel to the second part 5 of the L-shaped probe. A separation S is provided between the end of the second part 5 of the L-shaped probe 3 adjacent the first part 4 of the probe, and an edge along an x axis of the rectangular patch 1. The L-shaped probe 3 is located beneath the patch 1 equidistantly and symmetrically between the two edges along a y axis of the patch 1.

The patch 1 is supported spaced from the ground plane 2 by means of a dielectric material. Indeed multiple dielectric layers of differing materials may be provided if desired. In this embodiment, however, a single dielectric material made of foam is used with a dielectric constant $\epsilon_r=1$.

The preferred dimensions of the antenna are: $W_x=0.45\lambda$, $W_y=0.375\lambda$, $H=0.099\lambda$, $L_v=0.16\lambda$, $L_h=0.083\lambda$, and $S=0.03\lambda$.

In this embodiment the following exemplary dimensions were used for operation of the antenna at a frequency of 4.53 GHz.

| $W_x$/mm | $W_y$/mm | H/mm | $L_v$/mm | $L_h$/mm | S/mm | R/mm |
|---|---|---|---|---|---|---|
| 30 | 25 | 6.6 | 10.5 | 5.5 | 2 | 0.5 |

Figure 5:
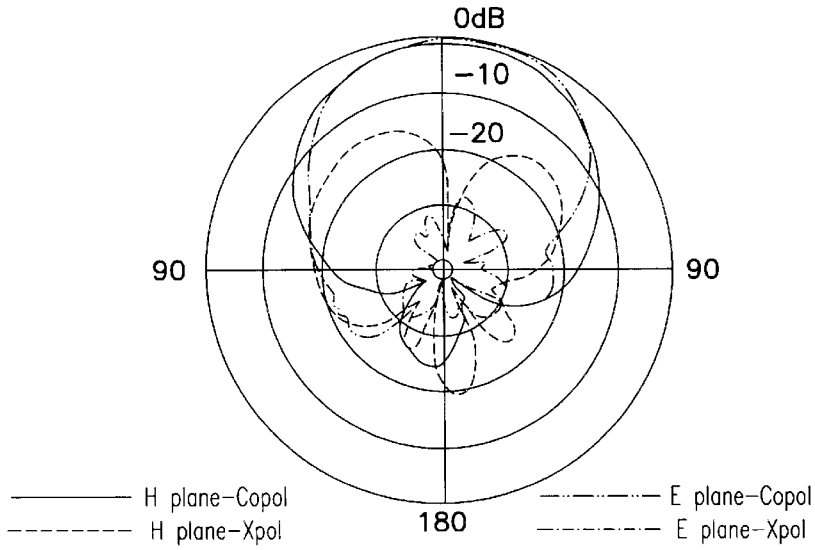
FIG. 5 is a plot showing the radiation pattern of the antenna of FIGS. 1 and 2.

FIG. 4 shows plots of gain and SWR against frequency for the antenna of the embodiment of FIGS. 1 and 2. The results show an impedance bandwidth of 35% and an average gain of 7.5 dBi. FIG. 5 shows a plot of the radiation pattern at 4.53 GHz. The gain of the antenna of this embodiment is slightly higher than a conventional patch antenna, usually about 6 dBi. The radiation pattern is symmetrical about the broadside. The cross-polarization is 15 dB below the co-polarization, which is acceptable in many applications.

In the embodiment of FIGS. 1 and 2 the patch is rectangular. Alternative patch configurations are possible, however, and FIGS. 3(*a*) and (*b*) show respectively alternative patch shapes as being circular or triangular. Another possibility as shown in FIG. 3(*c*) is to include a U-shaped slot in the rectangular patch.

Figure 6:
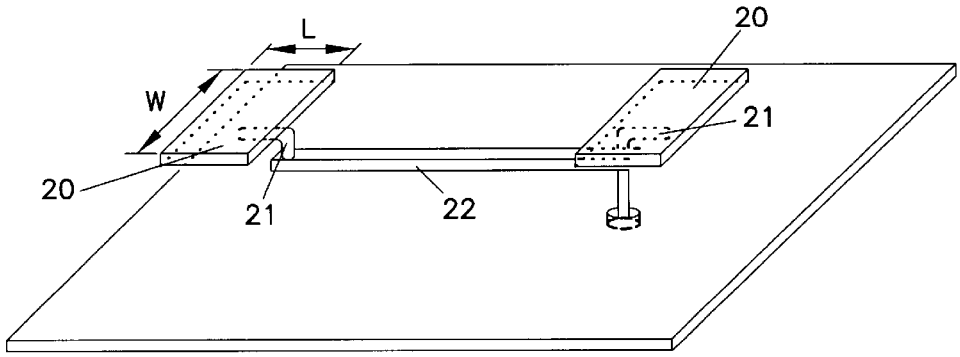
FIG. 6 is a perspective view of an antenna array according to a second embodiment of the invention.
Figure 7:
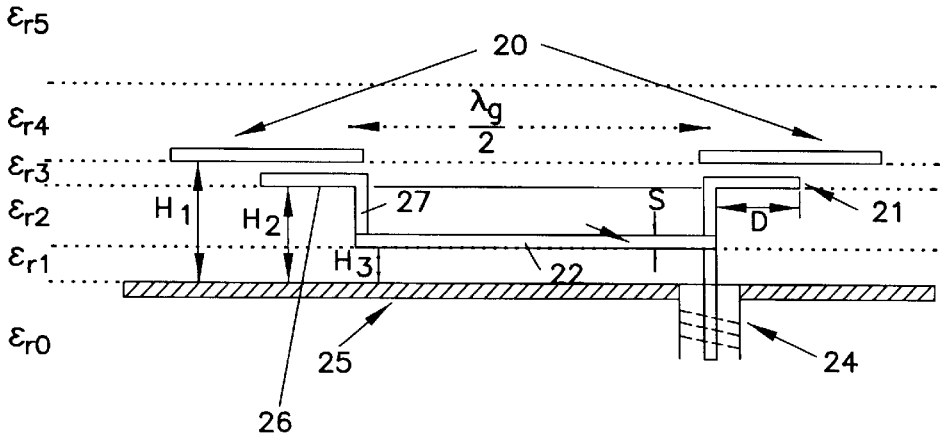
FIG. 7 is a side view of the antenna array of FIG. 6.

While the present invention is applicable to a single antenna as in FIGS. 1 and 2, a plurality of such antennas may be joined in an antenna array and FIGS. 6 and 7 show one example of such an array that may be suitable for a Personal Communication System (PCS) base station. As can be seen from FIG. 6 in particular, the array comprises two identical rectangular patch antennas 20, each being driven by identical but oppositely directed L-shaped probes 21 connected by a square transmission line 22. A coaxial feed is connected by a connector 24 directly to a first of the L-shaped probes 21 and to the other of the L-shaped probes 21 through the square transmission line 22. The length of the transmission line 22 is set at half the wavelength at the intended operating frequency.

As can be seen from FIG. 6 and in particular FIG. 7 there are a number of dimensions that can be defined. To begin with the two patch antennas 20 are identical and each has a length L in the direction parallel to the square transmission line 22 and a width W at right angles to the transmission line 22. Three heights may be defined: $H_1$ is the height of the patches 20 above the ground plane 25; $H_2$ is the height of the horizontal parts 26 of the L-shaped probes 21 above the ground plane; and $H_3$ is the height of the transmission line 22 above the ground plane 25. In addition the transmission line 22 has a width of S and a thickness S in the vertical direction which gives a height of $H_2$–$H_3$- S for the height of the vertical part 27 of the L-shaped probe. The L-shaped probe has a radius R.

As in the embodiment of FIGS. 1 and 2 there is the possibility for forming the antenna array with multiple dielectric layers supporting the patches and each having differing dielectric constants $\epsilon_r$, in this exemplary embodiment however all dielectric constants are set to 1 as air is used as the dielectric material.

In this embodiment the preferred dimensions are W=0.42λ, L=0.377λ, $H_1$=0.127λ, $H_2$=0.09λ, $H_3$=0.033λ, S=0.039λ , and D=0.171λ.

With an antenna array designed to operate at a frequency of 1.8 GHz the following dimensions are used.

| W/mm | L/mm | $H_1$/mm | $H_2$/mm | $H_3$/mm | S/mm | D/mm | R/mm |
|---|---|---|---|---|---|---|---|
| 70.6 | 62.8 | 21.2 | 15 | 5.5 | 6.5 | 28.5 | 0.8 |

Figure 8:
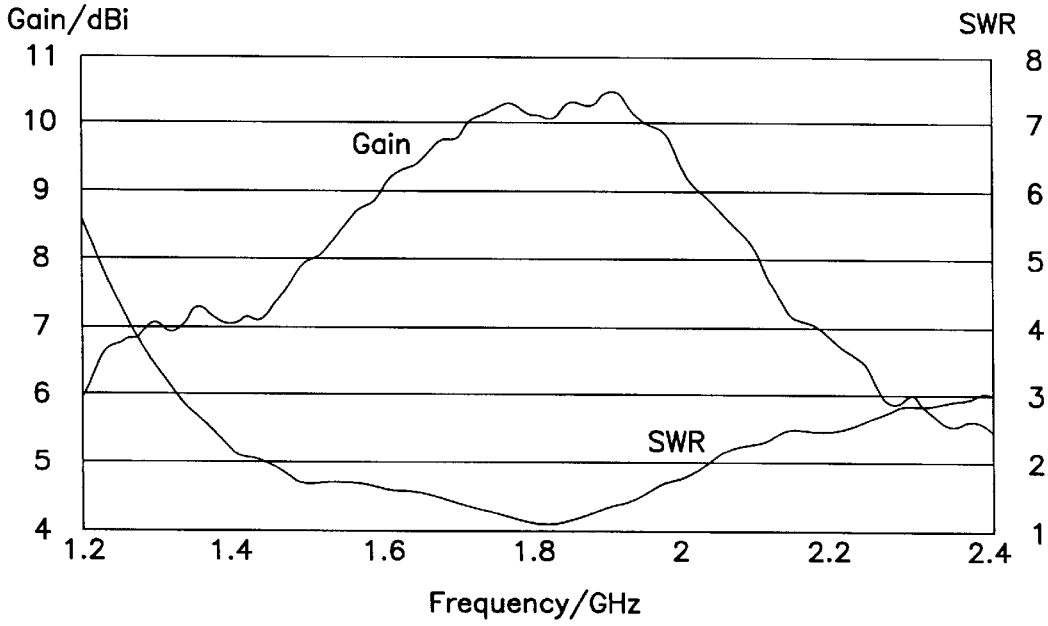
FIG. 8 is a plot showing gain and SWR against frequency for the antenna array of FIGS 6 and 7.
Figure 9:
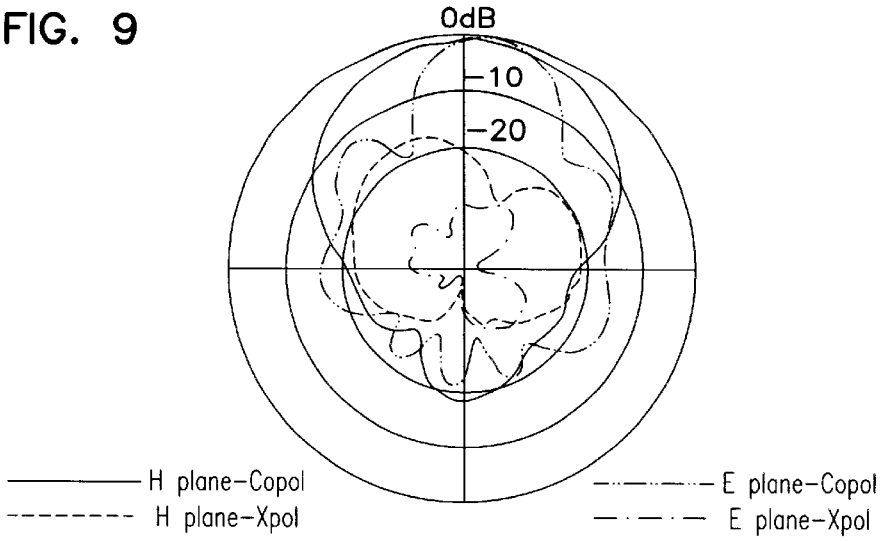
FIG. 9 is a plot showing the radiation pattern of the antenna array of FIGS. 6 and 7.

FIG. 8 shows plots of the gain and SWR of the antenna array of FIGS. 6 and 7, while FIG. 9 shows the radiation pattern of this antenna array at an operating frequency of 1.8 GHz. The results show an impedance bandwidth of 33% and a gain at the operating frequency of 1.8 GHz of 10.5 dBi. From the gain measurement, the efficiency of the array is seen to be very high. The feeding technique can reduce the cross-polarization level of the array in comparison with the single patch case, and can maintain the broad bandwidth performance.

Figure 10:
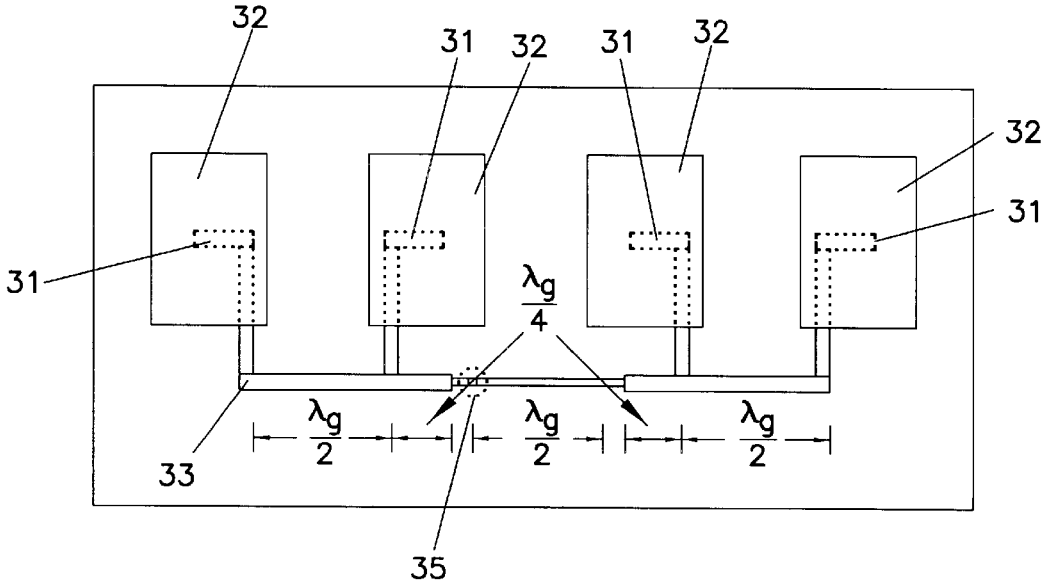
FIG. 10 is a plan view of an antenna array according to a third embodiment of the invention.
Figure 11:
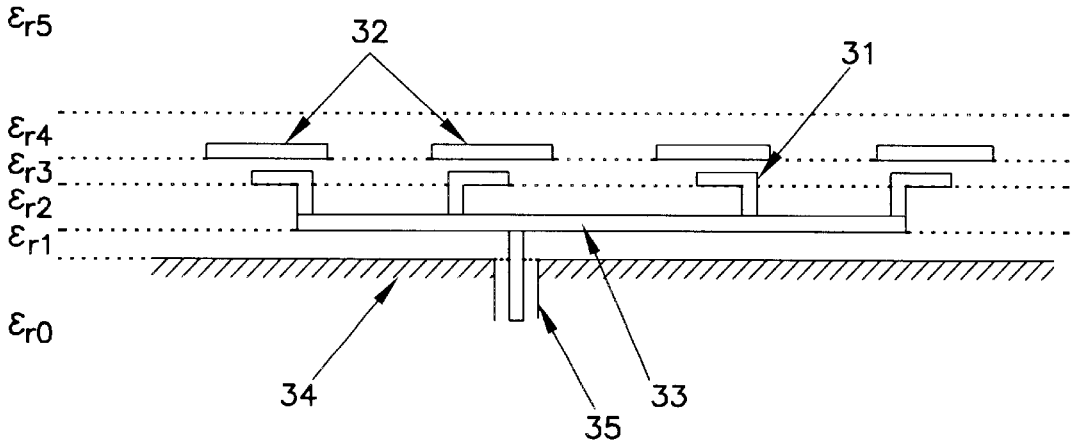
FIG. 11 is a side view of the antenna array of FIG. 10.

FIGS. 10 and 11 show a 4×1 array comprising four L-shaped probes 31 each feeding a respective rectangular patch antenna 32. The four L-shaped probes 31 are each connected to a common transmission line 33, spaced from a ground plane 34, and which in is connected to a connector 35. The four patch antennas 32 are arranged in a row as two pairs separated by λ/2 with a part of the transmission line connecting the two pairs being of reduced width for a distance of slightly more than λ/2 for conventional impedance matching purposes.

Figure 12:
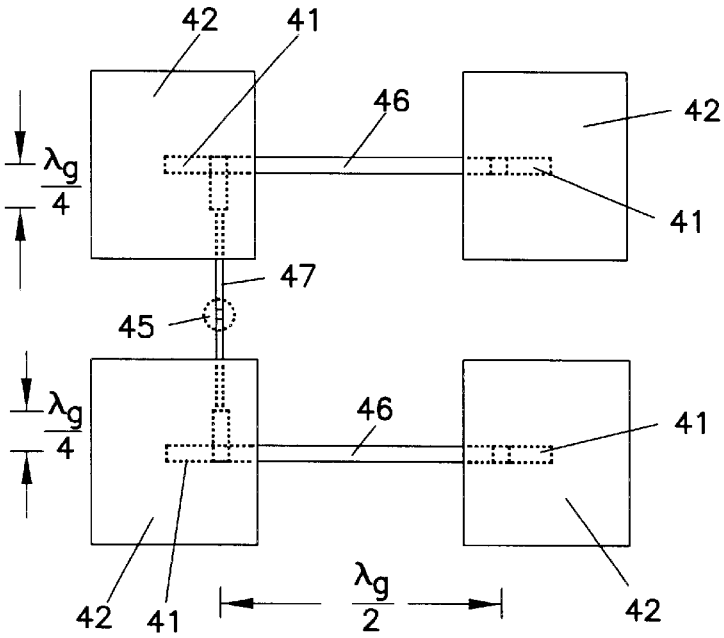
FIG. 12 is a plan view of an antenna array according to a fourth embodiment of the invention.
Figure 13:
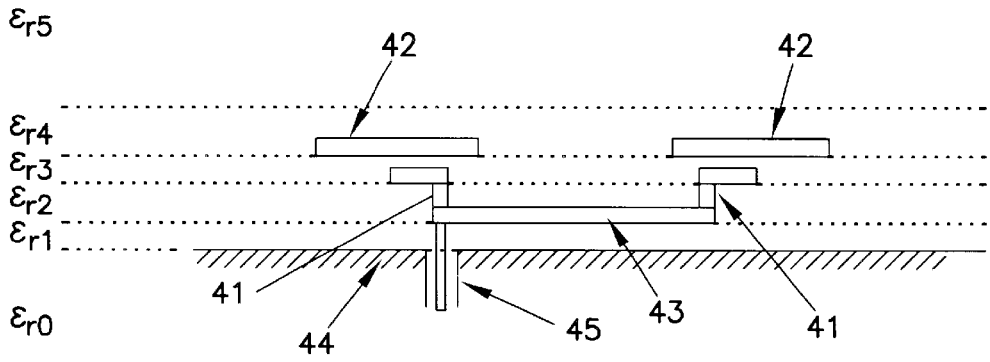
FIG. 13 is a side view of the antenna array of FIG. 12.

FIGS. 12 and 13 show a 2×2 array with four patch antennas 42 each fed by a respective L-shaped probe 41 and connected to a single transmission network 43 spaced from a ground plane 44. The array is fed from a single connector 45. The transmission network comprises first and second transmission lines 46 connecting pairs of patch antennas 42, and a third transmission line 47 interconnecting the first and second transmission lines 46. The connector 45 feeds the transmission network at a point half way along the third transmission line 47.

Figure 14:
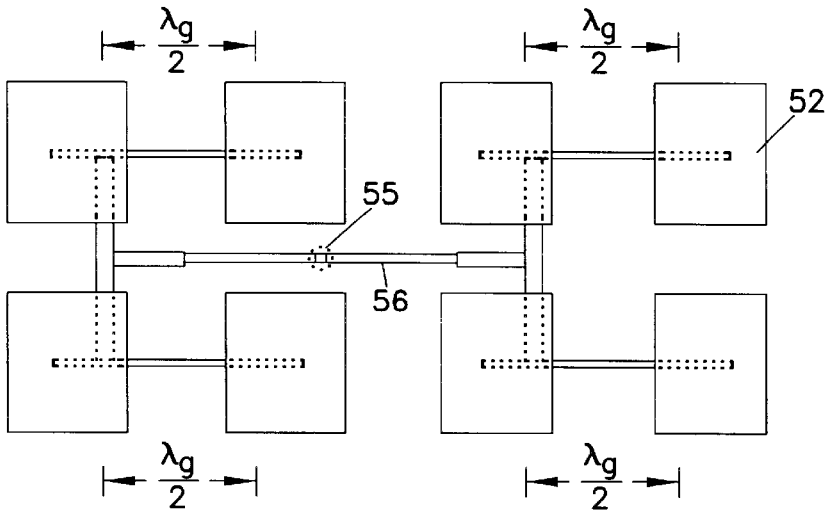
FIG. 14 is a plan view of an antenna array according to a fifth embodiment of the invention.
Figure 15:
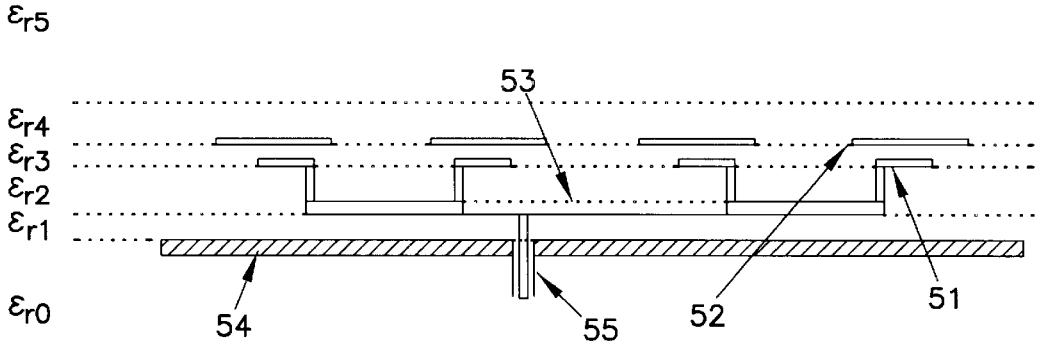
FIG. 15 is a side view of the antenna array of FIG. 14.

FIGS. 14 and 15 show a further possibility in the form of a 4×2 array with eight patch antennas 52 each fed by a respective L-shaped probe 51 and spaced above a ground plane 54. A common transmission network 53 is supplied by a single connector 55. This 4×2 array may be viewed as two 2×2 arrays of the type shown in FIGS. 12 and 13, with the two third transmission lines of the two 2×2 arrays being interconnected by a fourth transmission line 56 to form the single transmission network. The connector 55 supplies a coaxial feed to the network at a point half way along the fourth transmission line 56.

Figure 16:
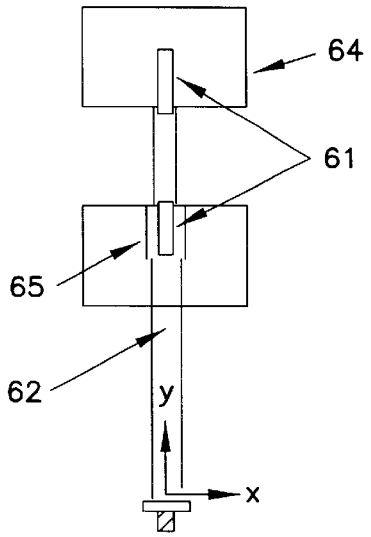
FIG. 16 is a plan view of an antenna array according to a sixth embodiment of the invention.
Figure 17:
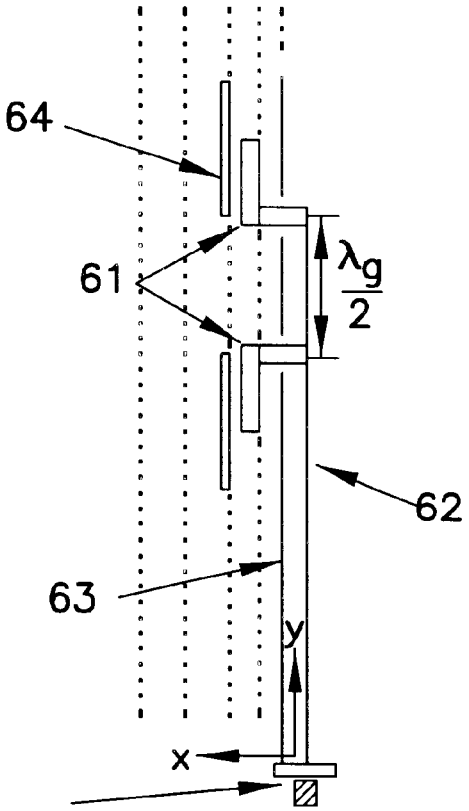
FIG. 17 is a side view of the antenna array of FIG. 16.

FIGS. 16 and 17 show a still further possibility in which the L-shaped probes 61 of a 2×1 array are fed from a microstrip feedline 62 disposed below the ground plane 63. The two probes 61 are spaced apart by λ/2 and each feed respective patch antennas 64. The microstrip feedline 62 is provided with a quarter-wave transformer 65.

What is claimed is:

1. An antenna comprising a patch disposed above a ground plane and spaced therefrom by a dielectric material, and an L-shaped probe disposed between said patch and said ground plane, said L-shaped probe having a first portion normal to said ground plane and said patch, and a second portion parallel to said ground plane and said patch, said first portion and said second portion of said L-shaped probe together form a single piece integrally formed structure, said antenna further comprising means for connecting said probe to means for transmitting a signal to or from said antenna, and said first portion of said L-shaped probe extending through said ground plane, wherein both said first portion and said second portion of said L-shaped probe are adapted to be electromagnetically coupled to said patch.

2. The antenna as claimed in claim 1, wherein said first portion of said L- shaped probe has an inductive reactance determined by the length of the first portion, and wherein the second portion has a capacitance reactance determined by the length of the second portion, the respective lengths of the first and second portion being selected such that the inductive reactance of the first portion is cancelled by the capacitive reactance of the second portion.

3. The antenna as claimed in claim 1, wherein said patch is rectangular.

4. The antenna as claimed in claim 1, wherein said patch is circular.

5. The antenna as claimed in claim 1, wherein said patch is triangular.

6. The antenna as claimed in claim 1, wherein said patch is provided with a U-shaped slot.

7. An antenna comprising a rectangular patch of dimensions $W_x$ by $W_y$ disposed above a ground plane and spaced therefrom by a dielectric material by a distance H, and an L-shaped probe disposed between said patch and said ground plane, said L-shaped probe having a first portion of length $L_h$ normal to said ground plane and said patch, and a second portion of length $L_v$ parallel to said ground plane and said patch and spaced from one edge of the patch by a distance S, said antenna further comprising means for connecting said probe to means for transmitting a signal to or from said antenna, wherein said antenna has the dimensions:

$W_x=0.45\lambda$ $W_y=0.375\lambda$ $H=0.099\lambda$ $L_v=0.16\lambda$ $L_h=0.083\lambda$ $S=0.03\lambda$ 8. An antenna array comprising a plurality of patches disposed above a ground plane and spaced therefrom by a dielectric material, each said patch having a respective L-shaped probe disposed between said patch and said ground plane, each said L-shaped probe having a first portion normal to said ground plane and said patch, and a second portion parallel to said ground plane and said patch, said first portion and said second portion of each said L-shaped probe together form a single piece integrally formed structure, said antenna array further comprising a transmission network connecting said probes to each other and to means for transmitting a signal to or from said antenna array.

9. The antenna array as claimed in claim 8, comprising two patches and wherein the respective L-shaped probes are connected by a transmission line.

10. The antenna array as claimed in claim 8, comprising four patches disposed in a line and each respective L-shaped probe being connected to a single transmission line.

11. The antenna array as claimed in claim 8, comprising four patches arranged in a 2×2 array and each respective L-shaped probe being connected to a transmission network comprising first and second transmission lines connecting respective pairs of L-shaped probes and a third transmission line connecting said first and second transmission line.

12. The antenna array as claimed in claim 11, comprising a 4×2 array consisting of two 2×2 arrays wherein a fourth transmission line is provided interconnecting the third transmission lines of the two 2×2 arrays.

13. The antenna array as claimed in claim 8, wherein at least two L-shaped probes are connected by a microstrip feedline disposed below the ground plane.

14. An antenna array comprising two rectangular patches having dimensions W×L disposed above a ground plane and spaced a distance $H_1$ therefrom by a dielectric material, each said patch having a respective L-shaped probe disposed between said patch and said ground plane, each said L-shaped probe having a first portion normal to said ground plane and said patch, and a second portion parallel to said ground plane spaced by a distance $H_2$ therefrom and having a length D, said antenna array further comprising a transmission line connecting said probes to each other and to means for transmitting a signal to or from said antenna array, said transmission line being parallel to said ground plane and spaced therefrom by a distance $H_3$, said transmission line having a width S and a thickness S and a length $\lambda/2$, and wherein $W=0.42\lambda$ $L=0.377\lambda$ $H_1=0.127\lambda$ $H_2=0.09\lambda$ $H_3=0.033\lambda$ $S=0.039\lambda$ $D=0.171\lambda$ 15. A wideband antenna comprising a patch disposed above a ground plane and spaced therefrom by a dielectric material having a thickness (H) in the range of from $0.08\lambda$ to $0.12\lambda$ (where $\lambda$ is the wavelength of the electromagnetic radiation the antenna is adapted to receive), and an L-shaped probe disposed between said patch and said ground plane, said L-shaped probe having a first portion having a length ($L_h$) normal to said ground plane and said patch, and a second portion having a length ($L_v$) parallel to said ground plane and said patch, said antenna further comprising means for connecting said probe to means for transmitting a signal to or from said antenna, and said first portion of said L-shaped probe having a length extending through said ground plane, wherein both said first portion and said second portion of said L-shaped probe are adapted to be electromagnetically coupled to said patch, and wherein the first portion has an inductive reactance ($X_L$) and the second portion has a capacitive reactance ($X_c$) such that $X_L+X_c\approx 0$.

* * * * *